US006182321B1

(12) United States Patent
Wu

(10) Patent No.: US 6,182,321 B1
(45) Date of Patent: Feb. 6, 2001

(54) TOOTHBRUSH

(75) Inventor: Ka Shing Wu, Kowloon (HK)

(73) Assignee: Addway Engineering Ltd. (HK)

( * ) Notice: Under 35 U.S.C. 154(b), the term of this patent shall be extended for 0 days.

(21) Appl. No.: 09/438,190

(22) Filed: Nov. 11, 1999

(51) Int. Cl.[7] ..... A46B 9/04
(52) U.S. Cl. ..... 15/167.1; 15/172
(58) Field of Search ..... 15/167.1, 172

(56) References Cited

U.S. PATENT DOCUMENTS 1,494,448 * 5/1924 Sookne .
1,796,001 * 3/1931 Church .
1,928,328 * 9/1933 Carpenter ..... 15/172
1,963,360 * 6/1934 Gibbin .
4,712,266 * 12/1987 Yamaki ..... 15/172
4,829,621 * 5/1989 Phenegar ..... 15/172
5,150,495 * 9/1992 Discko, Jr. ..... 15/172
5,694,658 * 12/1997 Huang ..... 15/172

FOREIGN PATENT DOCUMENTS

0083787 * 7/1983 (EP) ..... 15/172

* cited by examiner

*Primary Examiner*—Randall E. Chin
(74) *Attorney, Agent, or Firm*—Jackson Walker L.L.P.

(57) ABSTRACT

A toothbrush has a handle provided with a rigid curve wire axle at one end. A hollow shank and toothbrush head rotatable and snugly fit to the axle. In the configuration shown bristles on the head are concave. The bristle formation can be made convex by rotating the shank on the axle by 180°. This enables the bristle formation to be concave (as shown) or convex, and adopt configurations in between as desired by a user where the curvature is less concave (or less convex) by rotating the head to intermediary relative positions on the axle

4 Claims, 1 Drawing Sheet

TOOTHBRUSH

BACKGROUND OF THE INVENTION

1. Field of the Invention

The invention relates to toothbrushes.

2. Description of Prior Art

The shape of toothbrushes varies and in particular the shape of a shank and especially a head makes a difference to adjacent which part of the jaw the toothbrush is adapted to clean teeth the better. In order that one toothbrush may adopt and maintain various desirable shapes it has already been proposed to make the shank and the head flexible, such as in U.S. Pat. No. 5,749,381. To this end the shank and/or head is formed with reinforced plastics material where reinforcing wires enable the parts to be bent and held in a number of desirable shapes. To change the shape, the user must grip the toothbrush handle and the head and move these parts relatively to bend the toothbrush into each desired shape. Manually gripping or touching the head is not always hygienic and in any event dirties or wets one gripping hand.

SUMMARY OF THE INVENTION

It is an object of the invention to overcome or at least reduce this problem.

According to the invention there is provided a toothbrush having an elongate handle with a longitudinal axis, a rigid curved axle extending forward generally along the longitudinal axis from one end of the handle, and a hollow integrally formed shank and toothbrush head formed of flexible plastics material that rotatable fits over the axle along its length such that relative rotation of the toothbrush head or shank with respect to the axle causes the toothbrush head to take up different desired curved shapes.

The axle is preferably formed of metal.

The shank and toothbrush head may be removably fitted to the axle.

The shank is preferably integrally provided with peripheral finger-grippable formations.

BRIEF DESCRIPTION OF THE DRAWINGS

A toothbrush according to the invention will now be described by way of example with reference to the accompanying drawing in which.

DESCRIPTION OF THE PREFERRED EMBODIMENT

Figure 1:
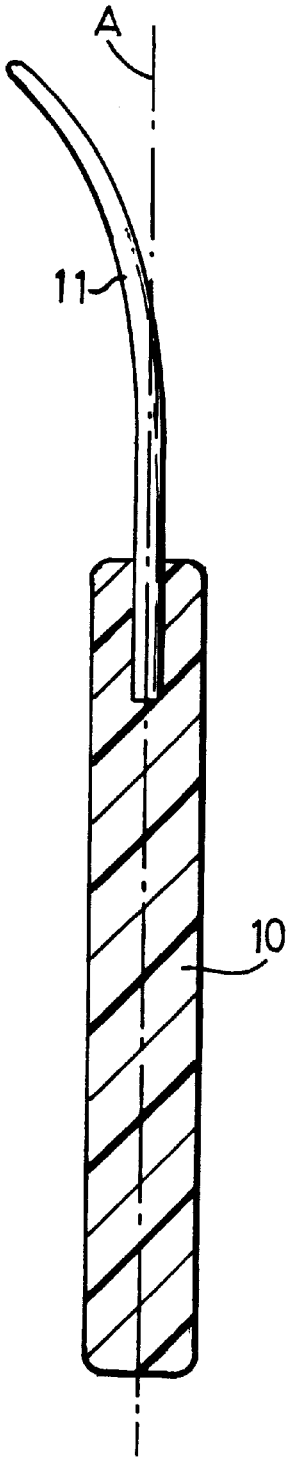
FIG. 1 is a sectional view of part of the toothbrush.

Referring to the drawings, an elongate toothbrush handle 10 has a central longitudinal axis A. A stiff bent metallic wire axle 11 extending forwards of one end of the handle 10 is rigidly fixed to the handle. An integrally formed hollow shank 12 and toothbrush head 13 is rotatable and snugly fitted to the axle 11. The shank 12 has finger-grippable peripheral formations 14 and bristles 15 are mounted to the head 12.

Figure 2:
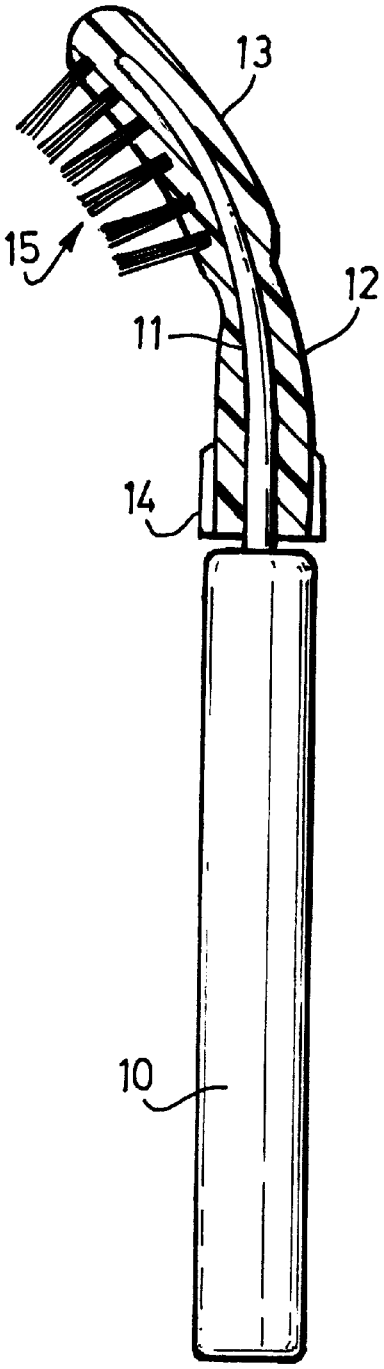
FIG. 2 is a part sectioned view of the toothbrush in one configuration.
Figure 3:
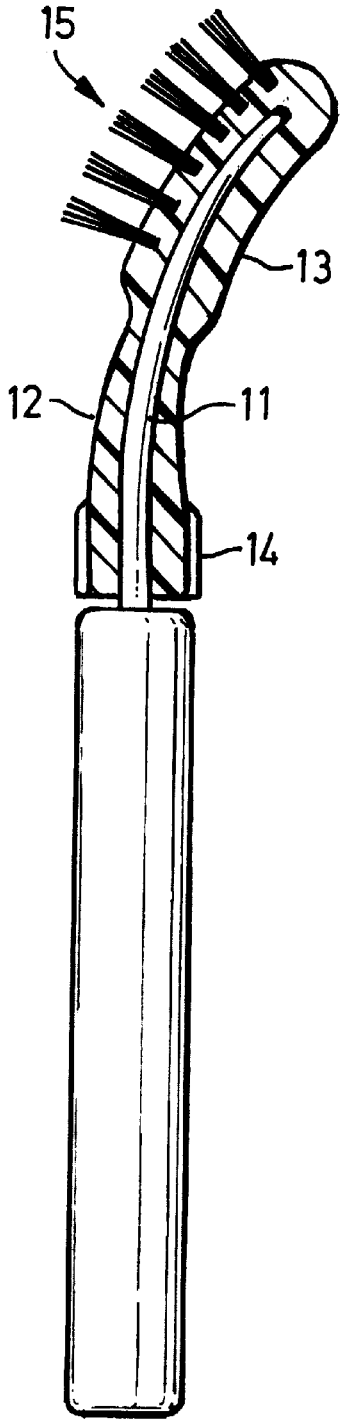
FIG. 3 is a part sectioned view of the toothbrush in another configuration; the toothbrush head and shank have been rotated ±180° relative the axle.

In use, the shape of the shank 12 and the toothbrush head 13 can be altered according to a user's requirements by rotating the shank with the toothbrush head relative to the axle 11. Plastics material forming the shank and toothbrush head is sufficiently flexible to allow the shank and toothbrush head to take up various configurations. The extreme configurations are shown in FIGS. 2 and 3, where the head is concaved and convexed respectively for cleaning applications of the bristles 15. In FIG. 3, the toothbrush head 13 and shank 12 have been rotated ±180° the axle 11. It will be noted that the relative rotation can be manually executed without touching the head or the bristles because the user can grip the shank 12, or the formations 14 where provided, to do the rotating.

It will be noted that usually the shank remains straight, or fairly straight, and only the toothbrush head is caused to change shape when the rotation takes place. This will in any event depend and be variably dependent on a chosen shape of the axle used.

The shank 12 and toothbrush head 13 can be arranged to slide off the axle 11 when not in use, or for cleaning, and replacements attached to the handle. A suitable head may be provided with only one tuft of bristles, as is otherwise known per se, so that the toothbrush can be used the better to clean between teeth. Also, several different shanks and heads may be used with the same handle so that members of a family can use their own toothbrush heads but commonly use the same handle for example. Conversely, different handles may be used with a same head which have axles of different degrees of curvature. In this way, a user may from time to time apply different amounts of concavity or convexity to his toothbrush head. On the contrary, as will be appreciated, FIGS. 2 and 3 show two extreme configurations ±180° about the axle 11, "partial" rotation of the toothbrush 13, on the axle 11 provides intermediate amounts of concavity or convexity for the bristle formation anyway.

The axle 11 may be formed of non-metallic rigid material if desired. The shank and toothbrush head may also be provided with a channel that has a number of axle bearing surfaces at intervals along its length if preferred, rather than fitting snugly along its whole length. The shank may be longitudinally held to the axle, once fitted, in situations where the shank is not made releasable from the axle in normal use.

I claim:

1. A toothbrush having an elongate handle with a longitudinal axis, a rigid curved axle extending forward generally along said longitudinal axis from one end of said handle, and a hollow integrally formed shank and toothbrush head formed of flexible plastics material that rotatable fits over said rigid curved axle along its length such that rotation of said head or shank between ±180° with respect to said curved axle causes said toothbrush head to take up different desired curved orientations.

2. A toothbrush according to claim 1, in which said axle is formed of metal.

3. A toothbrush according to claim 1, in which said shank and toothbrush head are removably fitted to said axle.

4. A toothbrush according to claim 1, in which said shank is integrally provided with peripheral finger-grippable formations.

* * * * *